United States Patent [19]

Hawkins et al.

[11] 4,261,399

[45] Apr. 14, 1981

[54] APPARATUS FOR CUTTING PILING AND THE LIKE

[75] Inventors: James B. Hawkins; Frank W. Carpenter; Robert E. Lange, all of Columbus, Ga.

[73] Assignee: Lummus Industries, Inc., Columbus, Ga.

[21] Appl. No.: 41,938

[22] Filed: May 24, 1979

[51] Int. Cl.[3] ..... B27B 23/00

[52] U.S. Cl. ..... 144/34 E; 83/399; 405/191

[58] Field of Search ..... 144/3 D, 34 R, 34 E, 144/309 AC; 83/399, 400, 151, 563, 613; 405/191; 30/92, 241

[56] References Cited

U.S. PATENT DOCUMENTS

| | | | |
|---|---|---|---|
| 2,612,194 | 9/1952 | Ingraham | 144/34 E |
| 3,056,267 | 10/1962 | McRee | 144/34 E |
| 3,421,558 | 1/1969 | Thompson | 144/34 E |
| 3,493,020 | 2/1970 | Choat | 144/34 E |
| 3,509,789 | 5/1970 | Dye | 83/399 |
| 3,565,141 | 2/1971 | Galis | 144/34 E |
| 3,667,515 | 6/1972 | Corey | 144/34 E |
| 4,168,729 | 9/1979 | Tausig et al. | 144/34 E |

*Primary Examiner*—W. Donald Bray
*Attorney, Agent, or Firm*—Hugh P. Carter

[57] ABSTRACT

Disclosed is apparatus for cutting piling, trees and the like, provided with means permitting the apparatus to be placed about a pile or the like by moving it generally normal to the longitudinal axis of the pile. Specifically, the apparatus comprises longitudinal frame members carrying at one end a driven blade and at the other end a stationary blade or anvil. The stationary blade is mounted on an end cross member, one end of which is pivotally secured to one of the longitudinal frame members and the other end of which is adapted for locking to the other of the members. By pivoting the end member carrying the stationary blade upwardly or out of the general plane of the frame, the device may be opened up so that it may be slipped about a piling or tree, without having to be lowered thereabout as has heretofore been required. Other details include specific means for locking the free end of the member carrying the stationary blade to the longitudinal frame; safety means preventing the actuation of the power source for the movable blade until the stationary blade is properly locked in position; and, a hydraulic system and suitable controls for the apparatus.

1 Claim, 13 Drawing Figures

FIG. 10
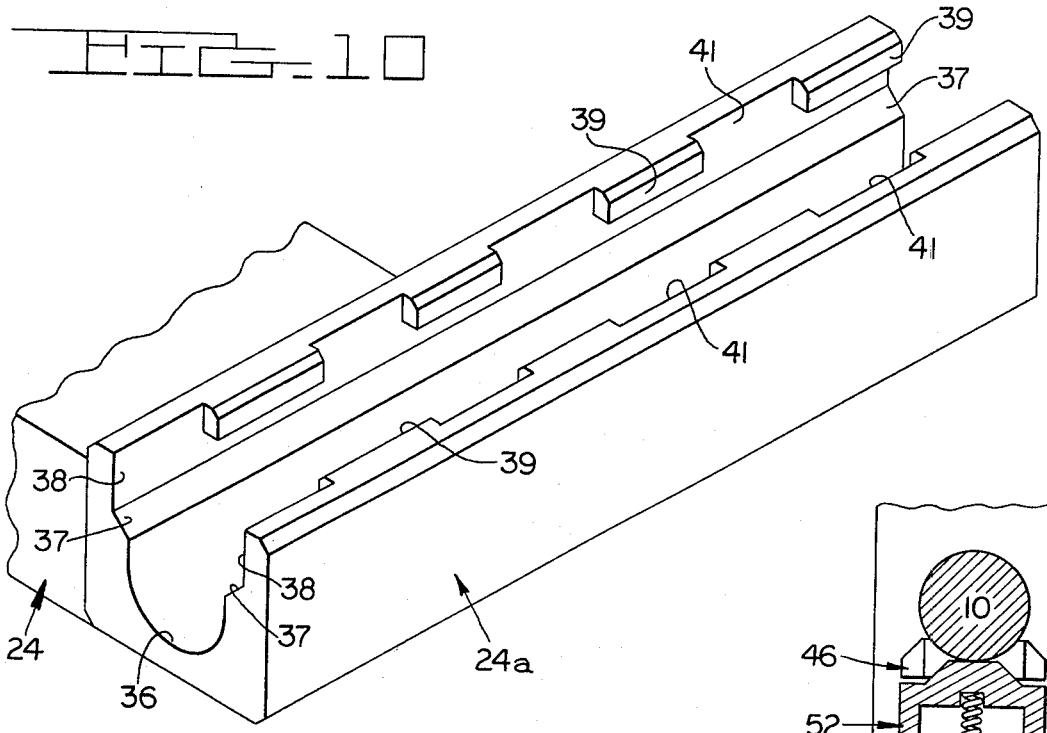
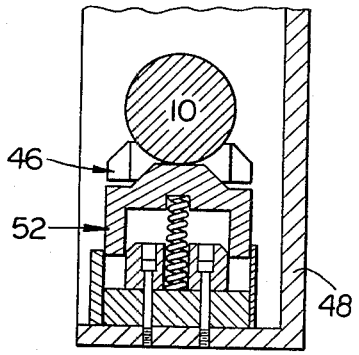
FIG. 12
FIG. 11
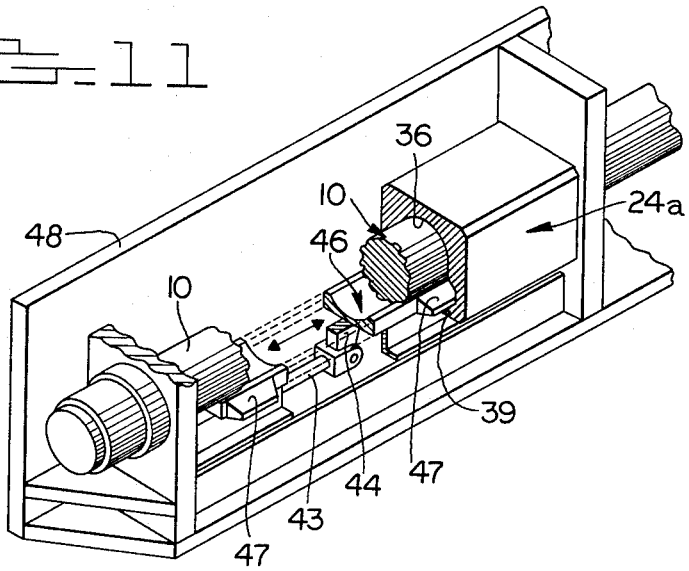

APPARATUS FOR CUTTING PILING AND THE LIKE

Our invention relates to improved apparatus for cutting piles, trees and the like and has for an object the provision of a cutter or shear the frame of which may be opened up to permit the same to be placed about a tree or piling by moving it normal to the longitudinal axis of the member to be cut, as distinguished from lowering it over the member to be cut.

Another object of our invention is to provide a cutter for trees, piling and the like, especially adapted for use under water, which shall be compact, capable of being placed about a piling or the like without lowering it from the top of the piling and which is provided with means to assure that the parts are fully assembled and in locked position prior to powering the movable blade on a cutting stroke.

Heretofore in this art it has been customary to provide apparatus for cutting piling or the like in which there was a closed peripheral frame formed of side members together with stationary and movable blades. In such prior art devices it was necessary to lower the apparatus about the pile. In many instances piles are cross braced relative to each other and with the prior apparatus it was impossible to place the same about the pile at the place along its axis where it was desired to cut the same. Further, the prior apparatus of this general nature with which we are familiar cannot be used at all to cut trees or the like simply because it could not be placed about the tree because of the limbs and other obstructions.

Briefly, our invention comprises a closed structure which is bounded on two sides by the frame and on the other two sides by movable and stationary blades. Means is provided to open this closed structure, preferably by pivoting one of the end members to one of the side frames and mounting the stationary blade on such pivoted member. Thus, the frame may be opened by pivoting the member carrying the stationary blade out of the general plane of the apparatus whereby the same may be slipped about a pile, tree or the like by moving it generally normal to the longitudinal axis of such object to be cut. It will thus be seen that our invention is characterized by the aforesaid capability and further by the fact that it is compact, permitting the same to be used for severing piles or the like which are spaced closely together. Our invention further is characterized by the provision of an improved hydraulic system for actuating not only the main cutting cylinder for the movable blade but also to operate a cylinder employed for pivoting the stationary knife toward and from closed position.

Apparatus illustrating features of our invention is shown in the accompanying drawings forming a part of this application in which:

FIG. 10 is an enlarged, isometric, inverted, detail view of the free end of the arm which carries the stationary blade, the view being designed to illustrate the locking teeth or lugs carried by the free end of said arm;

FIG. 11 is an isometric detail view, certain parts being broken away and in section, further illustrating the locking mechanism for the free end of the pivoted arm which carries the stationary blade;

FIG. 12 is an enlarged detail sectional view taken generally along the line 12—12 of FIG. 5; and, FIG. 13 is a wholly diagrammatic view illustrating the hydraulic system and controls therefor.

Figure 1:
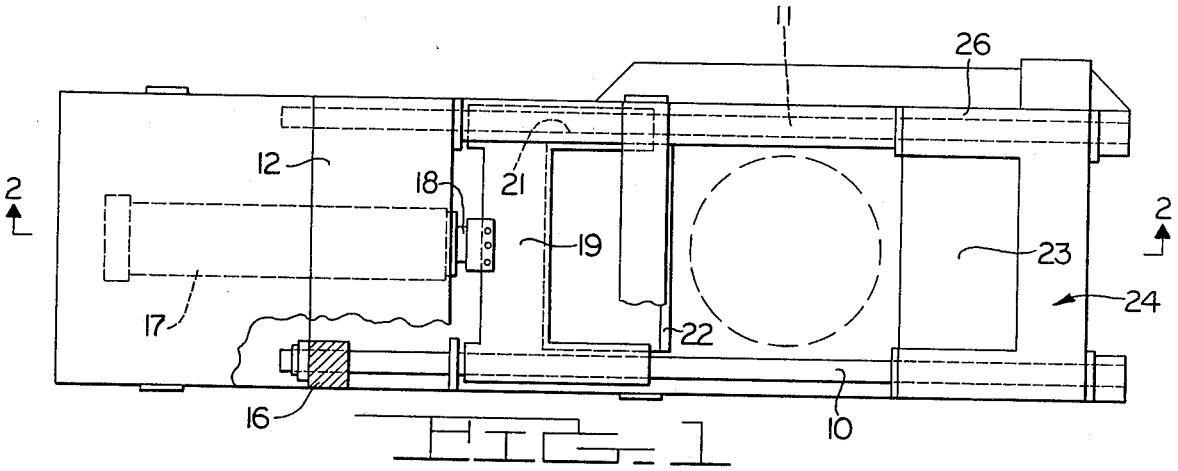
FIG. 1 is a plan view with the parts in closed position, as they would be after being placed about a pile to be cut.

Referring now to the drawings for a better understanding of our invention and particularly to FIGS. 1 to 4, inclusive, our improved shear comprises a pair of massive strain rods 10 and 11 which in effect form side frame members for the apparatus. At one end there is secured to the rods 10 and 11 cross plates 12 and 13 and extension plates 14. The plates 12 and 13 and the rods 10 and 11 are connected by relatively massive members 16.

Mounted to the frame members 12, 13 and 16 is a hydraulic cylinder 17 having a piston rod 18. A cross head 19 is slidably mounted by means of sleeves 21 on the members 10 and 11, which latter members may be steel rods. Carried by the cross head 19 is a movable shear blade 22. Thus, when fluid pressure is applied to the ends of the cylinder 17 the knife 22 is moved forwardly or rearwardly as will appear.

Figure 2:
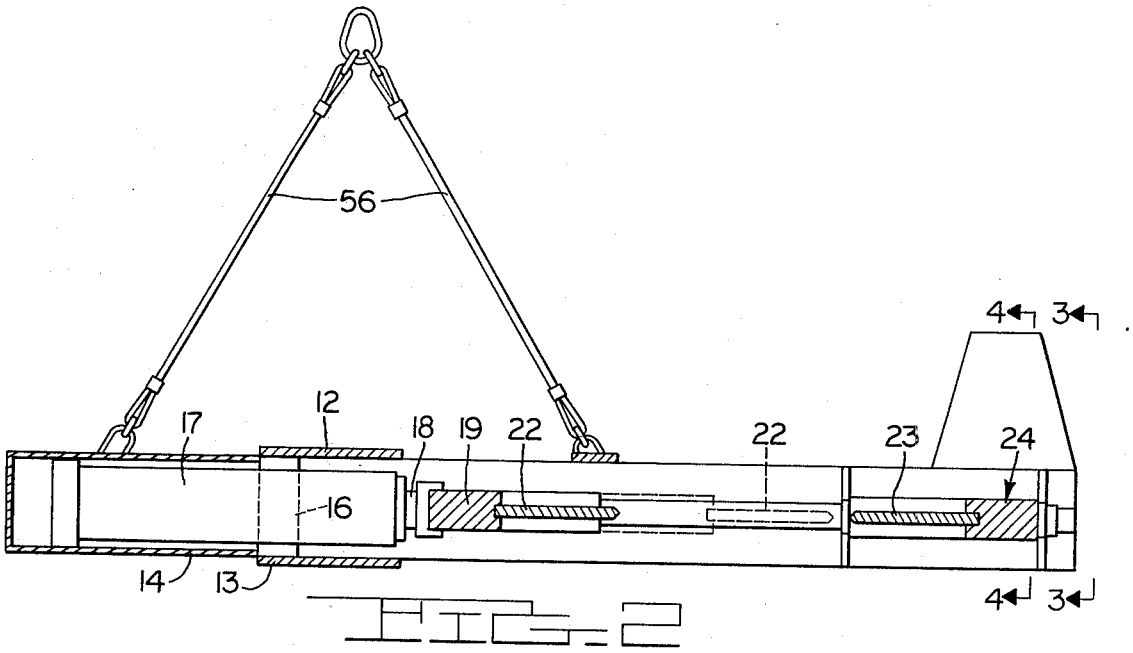
FIG. 2 is a detail sectional view taken generally along line 2—2 of FIG. 1.
Figure 3:
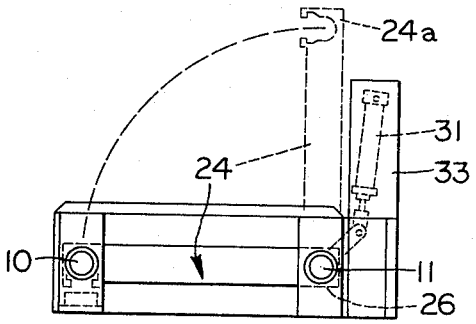
FIG. 3 is an end elevational view taken generally along line 3—3 of FIG. 2 with the end frame member carrying the stationary blade in raised, pile receiving position, as shown in dotted lines.
Figure 4:
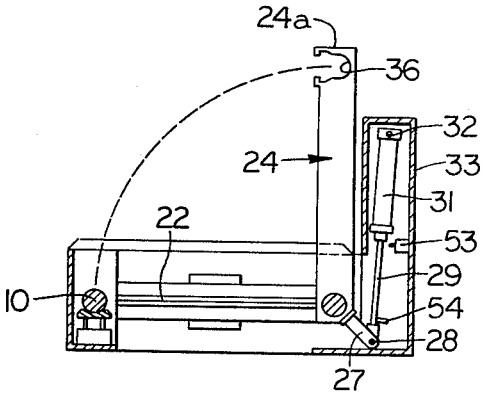
FIG. 4 is a detail sectional view taken generally along the line 4—4 of FIG. 2 with the end frame member carrying the stationary blade in raised, pile receiving position.

The stationary blade 23 for our improved shear is mounted on a cross member 24. The cross member 24 is pivotally connected at its end 26 to the strain member or frame portion 11 for movement from a closed position as shown in FIGS. 1, 2 and 3 to an open position as shown in dotted lines in FIG. 3 and in full lines in FIG. 4. As will appear, with the parts in the full line position of FIG. 4, the normally closed shear is opened up so that it may be placed about a pile or the like to be cut by sliding it normally about the pile.

The frame member 24 which carries the stationary knife is provided with an arm 27. Pivotally connected at 28 to the arm 27 is the end of a piston rod 29 carried by a fluid pressure cylinder 31. Cylinder 31 is pivoted at 32 to a frame section 33 carried by the side main frame member 11. Thus, when fluid pressure is admitted to the ends of cylinder 31, frame member 24 and hence blade 23 carried thereby may be moved from closed position to open position.

As before stated, we provide means to lock the free end 24$^a$ of the arm 24 to the main frame rod or member 10. To accomplish this the end 24$^a$ of the cross frame member 24 is grooved out as indicated at 36, thus to fit over the rod 10 when in lowered position. Further, the groove 36 is shaped as shown particularly in FIG. 10 by the outwardly sloped sections 37 and the upward, vertical section 38.

At intervals along the mouth or opening of the groove 36, in the section 38 thereof we provide inwardly projecting teeth 39 positioned along the groove from each other as indicated by the spaces 41. Thus, when lowered about the rod 10 the rounded portion 36 of the groove fits snugly on top of the rod 10 and the rows of spaced or interrupted teeth 39 lie generally beneath and outwardly of the frame member or rod 10.

Figure 5:
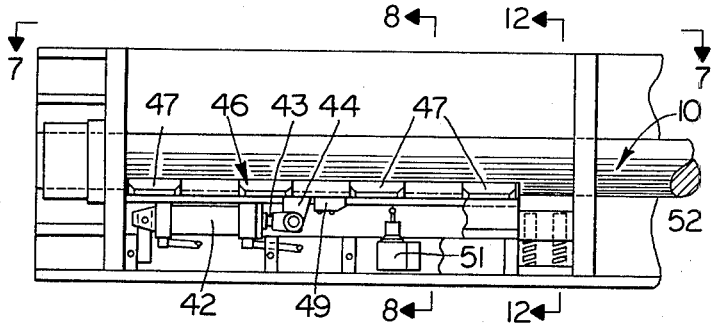
FIG. 5 is a fragmentary partly sectional view, with parts broken away, and illustrating the locking mechanism for the free end of the cross member which carries the stationary blade, the parts being shown with the lock mechanism disengaged, ready for the free end of the arm to be moved upwardly.
Figure 6:
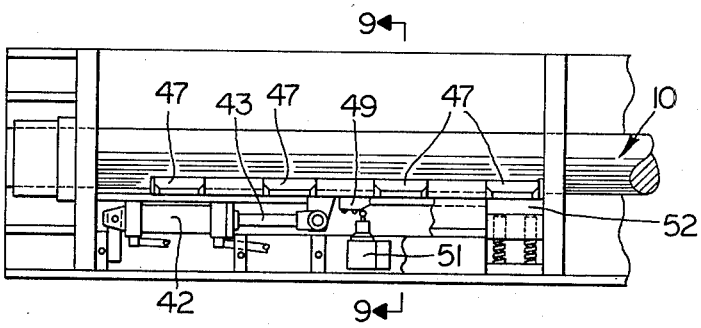
FIG. 6 is a view corresponding to FIG. 5 and showing the parts in locked, secured position.
Figure 7:
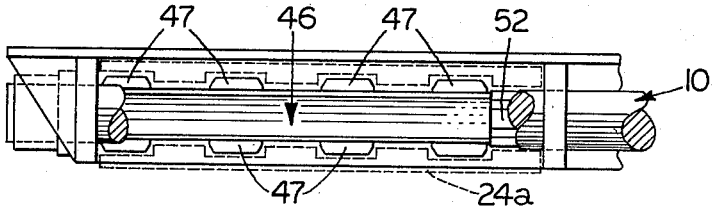
FIG. 7 is a detail fragmental view taken generally along line 7—7 of FIG. 5, certain of the parts being broken away and in section.
Figure 8:
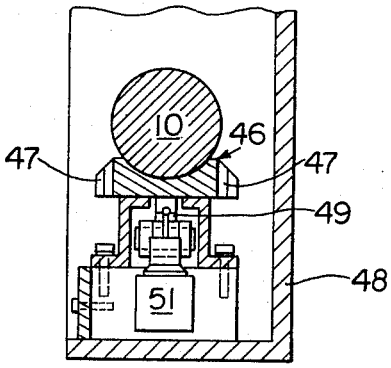
FIG. 8 is an enlarged detail sectional view taken generally along the line 8—8 of FIG. 5.
Figure 9:
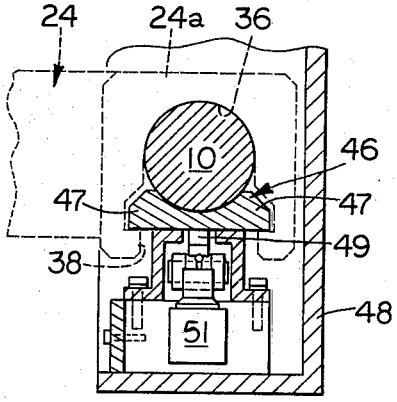
FIG. 9 is an enlarged detail sectional view taken generally along line 9—9 of FIG. 6.

At 42 we show still another hydraulic cylinder having a piston rod 43. This piston rod 43 is connected to a bracket 44 which depends from a locking plate 46. Constructed similarly to the notches and spaces 39–41, the plate 46 is provided with spaced teeth 47. The teeth 47 are adapted, when the locking bar 46 is withdrawn to the position of FIG. 5, to permit the free end 24$^a$ of the arm 24 to lower completely down onto the frame member 10, and to lie in the spaces 41 between the teeth 39. Therefore, with the parts in the position of FIG. 5 the arm 24 is free to pivot upwardly out of the plane of the device as a whole, to the position of FIG. 4. However, as shown in FIG. 6 whenever the hydraulic cylinder is actuated to extend its piston rod 43, the locking lugs or teeth 47 shift into a position to engage behind and lock with the teeth 39, thus securely locking the free end 24$^a$ of the arm to the main frame member 10.

It will be understood that the cylinder 42 is securely mounted on a box-like frame section 48 carried by the frame member or frame rod 10.

The slide or locking plate 46 carries a cam member 49. This cam member is adapted, when the parts are in locked position, FIG. 6, to engage the operating stem of a safety valve 51 and to close the same. The purpose of this will be later explained but it will here be mentioned that the object is to prevent the main cylinder 17 from being pressurized on its working stroke until the free end 24$^a$ of the member 24 is fully locked.

A further feature of our invention is the provision of a pilot valve 53 which is adapted to be contacted by a lug 54 on the piston rod 29 of cylinder 31, when the arm 24 is in locked position.

A still further feature of our invention is the inclusion of a safety lock 52 which is upwardly biased upon removal of the free end 24$^a$ of arm 24. This redundant safety, along with valve 53, prevents the engagement of locking plate 46 until free end 24$^a$ of arm 24 is in full down position for locking.

It will further be understood that the entire apparatus may be suspended by means of a sling 56 or the like from the boom of a crane, etc. so that it may be lowered under water for cutting piling.

Figure 13:
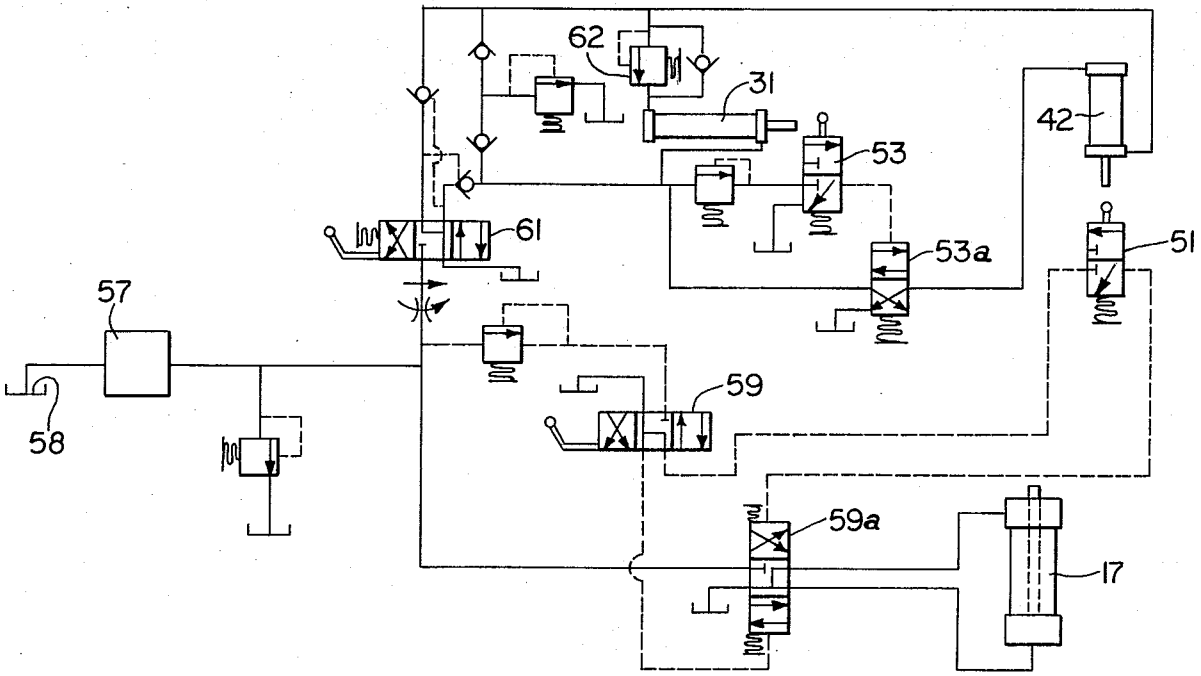

Referring now to FIG. 13, at 57 we show a source of fluid under pressure which may be a hydraulic unit, diesel powered, and equipped with a pressure compensated piston pump. The supply tank is indicated at 58. The oil flow is controlled manually by two four-way directional valves. The high volume valve 59 which controls a pilot valve 59$^a$ is connected to cycle the cutter blade 17 in and out as shown in FIG. 13. A lower volume valve 61 is used to control the cylinder 31 for raising and lowering the frame member 24 and the stationary knife 23 carried thereby.

With fluid under pressure being supplied as indicated the lock valve 61 may be opened. Oil flows through this valve to the cylinder 42, retracting the latch or locking plate 46. When the latch cylinder 42 bottoms out, the pressure increases to a point sufficient to open a sequence valve 62 which then allows oil to flow to cylinder 31, lifting the frame member and stationary blade. When the cylinder 31 is fully retracted, the stationary blade is lifted and the valve 61 may be centered, holding the frame member carrying the stationary blade in open position.

With the parts in the position just described the apparatus may be placed around a pile by lowering the same, for instance, under water, and then moving the apparatus about the opening at the end formed by raising the frame member and stationary blade. When the apparatus is properly about the pile to be cut frame member 24 and the stationary blade or anvil are lowered by manually shifting the control valve 61 to closed position. When the member 24 reaches locking position, pilot valve 53 is actuated, thereby piloting valve 53$^a$, allowing pressurized fluid to reach the latch cylinder 42. When the latching plate or lock member is in fully closed position, valve 51 is actuated. Valve 51 has been performing a safety function in that it has been blocking any pilot pressure to the main pilot operated valve 59$^a$, preventing the apparatus from being cycled into "cut" mode during those times when the member is not positively locked into position.

With the safety valve 51 blocked to tank, which is accomplished when member 24 is down and locked, the manually controlled pilot valve 59 can be shifted to "extend" position. Since this valve has the pilot pressure line closed to tank, pilot pressure will shift the main valve to allow oil to extend the cutter ram 17. After the piling has been cut member 24 may be opened again and the operation is repeated.

In view of the foregoing it will be seen that we have devised an improved, efficient and practical apparatus for cutting piling. Our design permits the provision of apparatus having various capacities, a typical capacity being on the order of about 300 tons of blade pressure. Our invention is characterized, particularly, by the fact that we are able to open up the normally closed frame consisting of the side frame members, the movable blade and the stationary blade, thus to permit the apparatus to be placed about a piling or the like to be cut by lateral movement between the two as distinguished from longitudinal movement, as heretofore has been necessitated.

While we have shown our invention in but one form, it will be obvious to those skilled in the art that it is not so limited, but is susceptible of various changes and modifications without departing from the spirit thereof.

What we claim is:

1. In apparatus for cutting piling and the like, (a) cooperating stationary and movable, powered blades, (b) a frame supporting said blades for relative movement toward each other thereby to shear a pile between the same, (c) said blades when in operating relation forming with the frame a peripherally closed structure bounded by the frame and by said blades, (d) power means operatively associated with said structure and effective when energized to open the closed structure thereby to permit the apparatus to be placed about a pile by moving it generally normal to the longitudinal axis of the pile, (e) lock mechanism means located adjacent the position on the apparatus at which the closed structure is opened and effective to secure the parts in closed, operating position, and (f) safety means associated with said locking mechanism effective to prevent the apparatus from initiating a cutting cycle until said lock means is fully engaged.

* * * * *